US011846127B2

(12) United States Patent
Rocci et al.

(10) Patent No.: US 11,846,127 B2
(45) Date of Patent: Dec. 19, 2023

(54) HANDLE FOR A VEHICLE DOOR

(71) Applicant: MINEBEA MITSUMI Inc., Nagano-ken (JP)

(72) Inventors: Antonio Rocci, Pianezza (IT); Anthony Guerin, Pianezza (IT); Guillaume Despreaux, Pianezza (IT)

(73) Assignee: MINEBEA MITSUMI INC., Nagano-Ken (JP)

( * ) Notice: Subject to any disclaimer, the term of this patent is extended or adjusted under 35 U.S.C. 154(b) by 83 days.

(21) Appl. No.: 17/380,497

(22) Filed: Jul. 20, 2021

(65) Prior Publication Data

US 2022/0018167 A1 Jan. 20, 2022

(30) Foreign Application Priority Data

Jul. 20, 2020 (EP) ..... 20186810

(51) Int. Cl.
*E05B 85/10* (2014.01)
*E05B 77/42* (2014.01)
*E05B 85/16* (2014.01)

(52) U.S. Cl.
CPC ..... *E05B 85/103* (2013.01); *E05B 77/42* (2013.01); *E05B 85/16* (2013.01)

(58) Field of Classification Search
CPC ..... E05B 85/103; E05B 77/42; E05B 85/16; E05B 85/107; E05B 85/10; E05B 5/00; E05B 5/003; E05B 5/006
See application file for complete search history.

(56) References Cited

U.S. PATENT DOCUMENTS 8,786,401 B2 * 7/2014 Sobecki ..... E05B 81/34 340/5.1
2002/0013980 A1 * 2/2002 Bella ..... E05B 77/42 16/412

(Continued)

FOREIGN PATENT DOCUMENTS

CN 108547523 9/2018
DE 102010056437 6/2012

(Continued)

OTHER PUBLICATIONS

Espacenet, Machine Translation of WO2017125653A1 description, generated Dec. 1, 2022 (Year: 2022).*

(Continued)

*Primary Examiner* — Kristina R Fulton
*Assistant Examiner* — Emily G. Brown
(74) *Attorney, Agent, or Firm* — Burris Law, PLLC

(57) ABSTRACT

A handle for a vehicle door that includes a grip member, a primary actuation mechanism, and a secondary actuation mechanism. The grip member is movable between a flush position, an active position range, and an opening position. The grip member includes a grip return device configured to drive the grip member toward the flush position. The primary actuation mechanism is moveable between a primary activating position range and a primary rest position. The secondary actuation mechanism is moveable between a secondary activating position range and a secondary rest position. The secondary actuation mechanism is configured to bring the primary actuation mechanism to the primary rest position after a predetermined time period after reaching a predetermined activating position in the primary activation position range.

13 Claims, 3 Drawing Sheets

(56) References Cited

U.S. PATENT DOCUMENTS

| | | | | |
|---|---|---|---|---|
| 2002/0121786 | A1* | 9/2002 | Meinke | E05B 77/42 292/336.3 |
| 2012/0205925 | A1* | 8/2012 | Muller | E05B 85/107 292/336.3 |
| 2016/0290018 | A1 | 10/2016 | Hamacher et al. | |
| 2017/0130493 | A1* | 5/2017 | Guerin | E05B 81/76 |
| 2018/0171686 | A1* | 6/2018 | Couto Maquieira | E05B 85/107 |
| 2019/0283555 | A1* | 9/2019 | Couto Maquieira | E05B 85/107 |
| 2019/0284850 | A1* | 9/2019 | Couto Maquieira | E05B 85/16 |
| 2020/0131814 | A1* | 4/2020 | Kuniyil | E05B 85/103 |
| 2020/0199918 | A1* | 6/2020 | Couto Maquieira | E05B 85/103 |
| 2020/0318397 | A1* | 10/2020 | Couto Maquieira | E05B 1/0053 340/5.1 |
| 2021/0189778 | A1* | 6/2021 | Sha | E05B 81/76 |

FOREIGN PATENT DOCUMENTS

| | | | | |
|---|---|---|---|---|
| DE | 102011001001 | A1 * | 6/2012 | E05B 85/103 |
| FR | 3024173 | A1 * | 1/2016 | E05B 85/107 |
| WO | WO-2012095084 | A1 * | 7/2012 | E05B 77/06 |
| WO | WO-2017125653 | A1 * | 7/2017 | E05B 15/0046 |

OTHER PUBLICATIONS

Espacenet, Machine Translation of WO2012095084A1 description, generated Nov. 30, 2022 (Year: 2022).*

European Search Report issued for EP Application 20186810, dated Dec. 10, 2020.

* cited by examiner

HANDLE FOR A VEHICLE DOOR

CROSS-REFERENCE TO RELATED APPLICATIONS

This application claims priority to and the benefit of EP 20186810.6, filed on Jul. 20, 2020. The disclosure of the above application is incorporated herein by reference.

FIELD

The present disclosure relates to handles for a vehicle door, also called "flush handles."

BACKGROUND

The statements in this section merely provide background information related to the present disclosure and may not constitute prior art.

Handles for vehicle doors are components having a significant influence on the style of vehicles.

In this respect, vehicle manufacturers often seek to arrange the handle in the plane of the door so that it occupies a flush position also called a flush arrangement. A flush handle generally renders the handle as invisible as possible. Such flush door handles also have the advantage of reducing the aerodynamic noise caused by the rush of air as the vehicle is being driven along.

As a new tendency coming on the market is to have motorized vehicle doors, flush handles are often requested to combine this tendency with the flushness of the car. In particular, mechanical flush handles are requested and used as a backup in case of electrical failure of the motorized vehicle door.

A flush handle generally includes a grip member and is configured to be moved by a user to grasp the grip member and pull the grip member to open the vehicle door.

Such a handle generally includes mechanisms, such as return levers, having sufficient force to allow the grip member of the handle to return to a flush position.

However, this configuration may create situations where the handle closes at undesirable times.

Efficient and effective operation of the mechanisms of the handle particularly the return of the grip member toward the flush position is desired and there is a need of a handle for a vehicle door, wherein the return of the handle, and particularly the grip member, toward the flush position does not occur prematurely.

SUMMARY

This section provides a general summary of the disclosure and is not a comprehensive disclosure of its full scope or all of its features.

The present disclosure provides a flush handle for a vehicle door, for example a motorized vehicle door, configured to return from an open position to a flush position with a low force.

The present disclosure relates to a handle for a vehicle door. The handle includes a grip member configured to cooperate with a latch of a vehicle door so as to unlatch the vehicle door. The grip member includes a gripping part. The grip member is movable between a flush position in which the gripping part extends flush to an external panel of the vehicle door, an active position range in which the gripping part projects with respect to the external panel and becomes graspable, and an opening position in which the grip member is configured to cooperate with the latch so as to unlatch the vehicle door. The grip member includes a grip member return means configured to drive the grip member toward the flush position. A primary actuation mechanism is moveable between a primary activating position range in which the primary actuation mechanism is configured to cooperate with the grip member and to urge the grip member towards the active position range, and a primary rest position in which the primary actuation mechanism is configured to release the grip member. A secondary actuation mechanism is moveable between a secondary activating position range in which the secondary actuation mechanism is configured to cooperate with the primary actuation mechanism and to urge the primary actuation mechanism toward the primary rest position, and a secondary rest position in which the secondary actuation mechanism is configured to retain the primary actuation mechanism in the primary rest position.

In some configurations, the secondary actuation mechanism is configured to bring the primary actuation mechanism to the primary rest position after a predetermined time period after reaching a predetermined activating position in the primary activation position range.

In some configurations, the grip member, the first actuation mechanism and the secondary actuation mechanism are separated elements. That is to say, distinct elements. In other words, they are independent from each other.

In some configurations, the handle according to the present disclosure provides a mechanism where a mechanical arrangement allows the grip member to be displaced after a predetermined time period from the active position range to the flush position under the action of the grip member return means.

In some configurations, the grip member according to the present disclosure is configured to return to the flush position independently, under the action of its own return means.

Thus, thanks to the handle according to the present disclosure, the return force of the handle is not related to other mechanical stresses such as those of the return levers of the background.

Active position range means a set of positions wherein the user can grab the grip member. Range can mean a set of positions around an outgoing position, for example position where the grip member forms an angle between 12° and 15° relative to the rest position or a single position for example between 12° and 15° relative to the rest position.

Predetermined time period means a time period before the primary actuation mechanism begins to be displaced by the secondary actuation mechanism and/or a time period taken by the primary actuation mechanism to be displaced from the primary activation range to the primary rest position by the secondary activating position.

According to one form, the secondary actuation mechanism includes a secondary actuation lever cooperating with the primary mechanism.

According to another form which can be considered alone or in combination, the grip member is configured to be moveable to a pushed position wherein the grip member is configured to push the secondary actuation mechanism towards the secondary activating position range.

According to another form, the primary actuation mechanism includes a return means configured to drive the primary actuation mechanism toward the activating position range.

In yet another form, the secondary actuation mechanism includes a return means configured to drive the primary actuation mechanism toward the primary rest position.

In still another form, the force of the secondary actuation mechanism return means is greater that the force of the primary actuation mechanism return means and the force of the primary actuation mechanism's is greater than the force of the grip member's return means.

According to still another form, the grip member is displaced from the active position range to the flush position with a damping effect.

According to a further form, the return means of the secondary actuation mechanism includes a damper or a damping element.

In yet another form, the grip member is displaced from the active position range to the flush position after a predetermined time period.

In another form, the predetermined time period is between 5 and 10 seconds.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
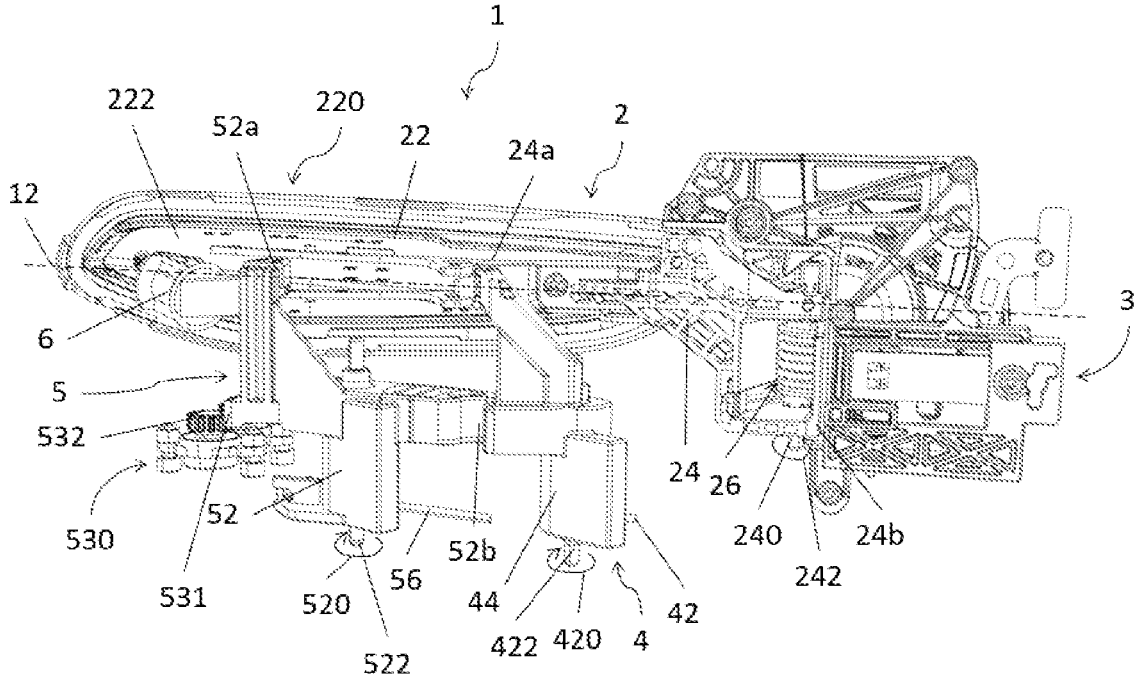
FIG. 1 is a perspective view of a handle according to the present disclosure in a flush position.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIGS. 1 to 6, the handle 1 according to the present disclosure includes a grip member 2.

The grip member 2 is configured to cooperate with a latch 3 of a vehicle door to unlatch the vehicle door. The handle 1 allows a user to open a vehicle door comprising an external panel represented in dashed line 12 (FIG. 1).

The grip member 2 includes a gripping part 22 and a grip lever 24. The gripping part 22 is configured to be grasped by a user trying to open the door. The gripping part 22 is connected to the grip lever 24.

The grip lever 24 has a first end 24*a* connected to the gripping part 22 and a second end 24*b* configured to cooperate with the latch 3 to activate the latch 3. The grip lever 24 is rotationally mounted about a mounting bracket 10 around a grip axis 240.

The gripping part 22 includes a recess 220 configured to receive at least one or more fingers so as to be grasped.

The grip member 2 is movable between a flush position (FIG. 1) in which the gripping part 22 extends flush to an external panel (represented by dashed line 12) of the vehicle door, an active position range (FIG. 3) in which the gripping part 22 projects with respect to the external panel (represented by dashed line 12) and becomes graspable, and an opening position (FIG. 4) in which the grip member 2 is configured to cooperate with the latch so as to unlatch the vehicle door.

The handle 1 is configured to be moveable such that when the gripping part 22 is displaced, the grip lever 24 is rotated about the grip axis 240.

Figure 5:
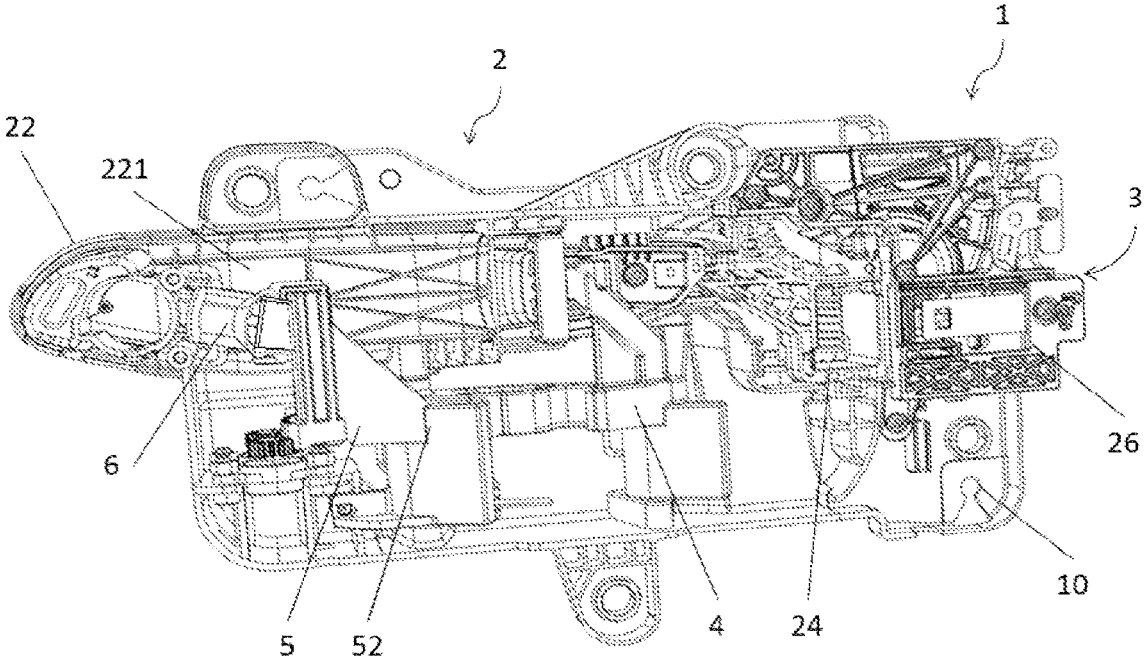
FIG. 5 is another perspective view of the handle of FIG. 1 in the flush position.

The flush position is shown in FIGS. 1 and 5. In this position, the gripping part 22 extends flush to an external panel (represented by dashed line 12) of the vehicle door. To this end, the gripping part 22 includes an external surface substantially aligned with the external panel as shown in FIG. 1.

Figure 3:
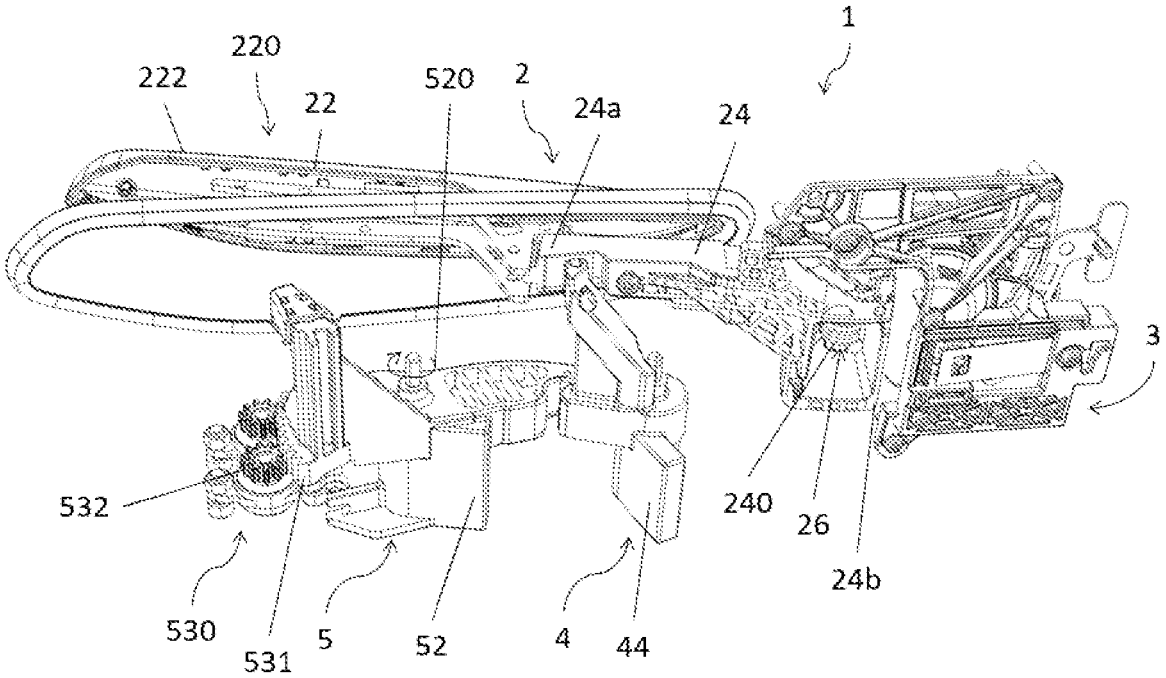
FIG. 3 is a perspective view of the handle of FIG. 1 in an active position.
Figure 4:
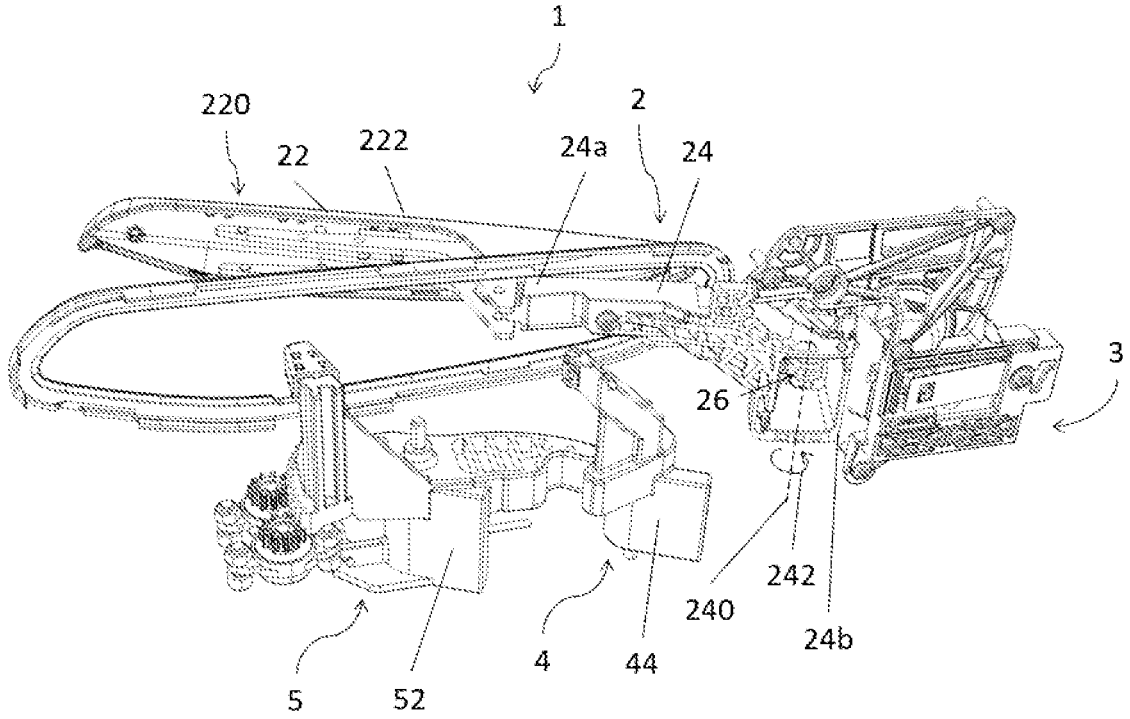
FIG. 4 is a perspective view of the handle of FIG. 1 in an open position.

The active position range is shown in FIG. 3. In this position, the gripping part 22 projects outwardly with respect to the external panel such that the grip recess 220 is accessible by a user.

The grip member 2 is configured to reach the opening position after being in the active position. In addition, the grip member 2 is configured to cooperate with the latch 3 when put in the opening position so as to unlatch the door.

The grip member 2 includes a grip member return means or device 26 configured to drive the grip member 2 toward the flush position (FIG. 1). That is to say, to make the grip member 2 return from the active position (FIG. 3) to the flush position (FIG. 1) according to arrow 242 in FIG. 1. In particular, the grip member return means 26 may include a torsion spring.

The handle of the present disclosure further includes a primary actuation mechanism 4.

The primary actuation mechanism 4 is moveable between a primary activating position range (FIGS. 3 and 4) in which the primary actuation mechanism 4 is configured to cooperate with the gripping part 22 and to urge said gripping part 22 towards the active position range, and a primary rest position (FIG. 1) in which the primary actuation mechanism 4 is configured to release the gripping part 22.

The primary actuation mechanism 4 includes a return means or device 42 configured to drive the primary actuation mechanism 4 toward the activating position range according to arrow 420 (FIG. 1). In particular, the return means 42 may include a torsion spring.

According to one form of the present disclosure, the primary actuation mechanism 4 includes a primary actuation lever 44. The primary actuation lever 44 is rotationally mounted about the mounting bracket 10 around a primary actuation rotation axis 422. According to this example form, the return means 42 is configured to drive the primary actuation lever 44 toward the activating position range according to arrow 420 (FIG. 1).

The primary actuation lever 44 is configured to cooperate with the grip member 2 to drive the grip member 2 between the flush position and the active position.

Figure 2:
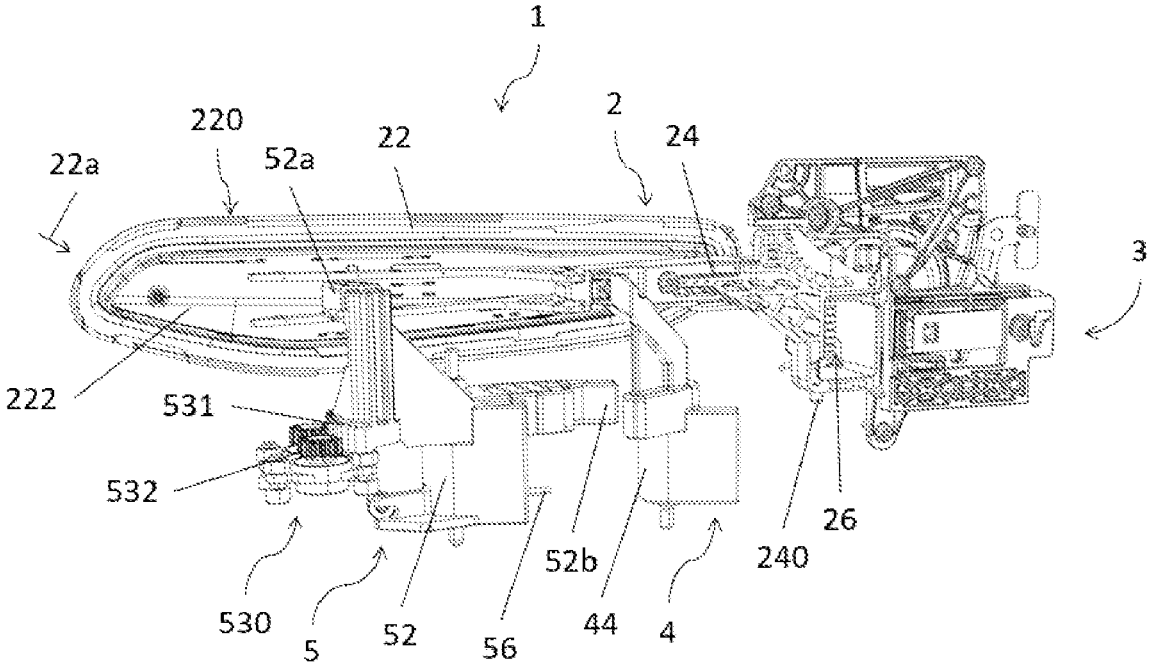
FIG. 2 is a perspective view of the handle of FIG. 1 in a pushed position.

The primary actuation lever 44 cooperates with the grip member 2 to drive the grip member 2 from the flush position to the active position as shown in FIGS. 1 to 3. More particularly, the primary actuation lever 44 is configured to push the grip lever 24 and thereby cause the gripping part 22 to project outwardly with respect to the external panel (represented by dashed line 12) of the vehicle door.

The handle 1 of the present disclosure further includes a secondary actuation mechanism 5.

The secondary actuation mechanism 5 is moveable between a secondary activating position range (FIG. 3) in which the secondary actuation mechanism 5 is configured to cooperate with the primary actuation mechanism 4 and to urge the primary actuation mechanism 4 toward the primary rest position (FIG. 1), and a secondary rest position (FIG. 1) in which the secondary actuation mechanism 5 is configured to retain the primary actuation mechanism 4 in the primary rest position.

The secondary actuation mechanism 5 includes a secondary actuation return means or device 56 configured to drive the secondary actuation mechanism 5 toward the secondary rest position according to arrow 520 on FIG. 1. In particular, the secondary actuation return means 56 may include a torsion spring.

According to a form of the present disclosure, the secondary actuation mechanism 5 includes a secondary actuation lever 52. The secondary actuation lever 52 is rotationally mounted about the mounting bracket 10 around a secondary actuation rotation axis 522 (FIG. 1). According to said form, the return means 56 is configured to drive the secondary actuation lever 5 toward the secondary rest position range according to arrow 520 on FIG. 1.

The secondary actuation lever 52 includes a secondary actuation lever first end 52*a* configured to cooperate with the grip member 2. The secondary actuation lever 52 includes a secondary lever second end 52*b* configured to cooperate with the primary actuation lever 44. The secondary actuation lever first end 52*a* and secondary lever second end 52*b* are located on opposite sides of the secondary activation rotation axis.

The secondary actuation lever 52 is configured to cooperate with the primary actuation lever 44 so as to drive the primary actuation lever 44 between the primary activating position range and the primary rest position.

The secondary actuation lever 52 cooperates with the primary actuation lever 44 to drive the primary actuation lever 44 toward the primary rest position as shown in FIG. 3. More particularly, the secondary actuation lever 52 is configured to drive the primary actuation lever 44 and thereby cause the primary actuation lever 44 to return to the primary rest position.

The secondary actuation mechanism 5 includes a return means or device 56 configured to drive the primary actuation mechanism 4 toward the primary rest position according to arrow 520 FIGS. 1 and 3.

The secondary actuation mechanism 5 is configured to bring the primary actuation mechanism 4 to the primary rest position after a predetermined time period after reaching a predetermined activating position in the primary activation position range.

For this purpose and according to another form of the present disclosure, the return means 56 of the secondary actuation mechanism 5 includes a damper.

The damper allows the secondary actuation mechanism 5 to return slowly to the secondary rest position and thus to the primary actuation mechanism to return slowly to the primary rest position. Alternatively, the secondary actuation mechanism 5 includes at least one damping element 530 which can be arranged on the secondary actuation mechanism 5 and which slows down the return movement of the secondary actuation mechanism 5. Preferably, at least one tooth flank 531, in the particular example shown a plurality of tooth flanks 531, are arranged on the secondary actuation mechanism 5 and are connected to at least one gear wheel 532, arranged on the secondary actuation mechanism 5. The gear wheel 532 cooperates with the plurality of tooth flanks 531 and works as a damping element with the tooth flanks 531 and slows down the return movement of the secondary actuation mechanism 5.

In operation, when the grip member 2 is in the flush position, the primary actuation lever 44 is in the primary rest position and stops on the secondary actuation lever second end 52*b*, but not on the grip member 2. The secondary actuation lever 52 is in the secondary rest position and the secondary actuation lever first end 52*a* stops on an adjustable stop 6 (FIG. 1). The grip member 2 stops on the secondary actuation lever first end 52*a*.

The adjustable stop 6 allows the position of the handle grip member 2 to be adjusted.

The adjustment of the adjustable stop 6 permits to adjust the position of the secondary actuation lever 52 and thus the position of the grip member 2 which stops on the secondary actuation lever 52.

This configuration corresponds to a balance position made possible thanks to the force of the different return means. For this purpose, the force of the secondary actuation mechanism return means 56 is greater that the force of the primary actuation mechanism return means 42 and the force of the primary actuation mechanism return means 42 is greater than the force of the grip member return means 26.

The grip axis, the primary actuation rotation axis 422 and the secondary actuation rotation axis 522 may in particular be essentially parallel, i.e., may form a relative angle of less than 30°. Also the axis may be parallel with an external panel general plane, i.e., may form a relative angle of less than 30° with the plane.

In operation, when the grip member 2 is in the flush position, the user wanting to open the corresponding vehicle door pushes the gripping part 22 toward a pushed position (FIG. 2).

The grip member 2 is configured to be moveable to the pushed position such that when the gripping part 22 is pushed by the user according to arrow 22*a* in FIG. 2, the grip lever 24 is rotated about the grip axis 240.

The grip member 2 in the pushed position is configured to push the secondary actuation lever first end 52*a* such that the secondary actuation lever 52 is moved towards the secondary activating position range (FIG. 2). In particular, the grip member 2 pushes the secondary actuation lever first end 52*a* toward the inside of the vehicle. The grip member 2 also comes into contact with the primary actuation lever 44 to push the primary actuation lever 44 in particular toward the inside of the vehicle (FIG. 2).

Since the secondary actuation lever first end 52*a* is moved towards the inside of the vehicle, the secondary actuation lever second end 52*b* located on the opposite side of the secondary actuation rotation axis is moved toward the outside of the vehicle. The primary actuation lever 44 is therefore released from the contact with the secondary actuation lever second end 52*b*. The primary actuation lever 44 is urged toward the primary actuation position range due to its return means (FIGS. 2 and 3).

During the displacement of the primary actuation lever 44, the later comes into contact with the grip lever 24 of the grip member 2 and drives the grip member 2 toward the active position range (FIG. 3) since the force of the primary actuation return means 42 is greater than the grip member return means 26.

According to a first variation of the present disclosure, the secondary actuation lever 52 is configured to return toward the secondary rest position directly after reaching the secondary activating position range due its return means 56.

The return of the secondary actuation lever 52 is slowed due to the damper or the damping element 530.

At some point, the primary actuation lever 44 moving toward an extreme position within the primary actuation position range, comes into contact with the secondary actuation lever second end 52*b* which has already started to return toward the secondary rest position (FIG. 3).

The secondary actuation lever 52, urges the primary actuation lever 44 toward the primary rest position against the force of the primary actuation return means 42. This is made possible because of the force of the secondary actuation return means 56 which is greater than the force of the primary actuation return means 42.

With the primary actuation lever 44 driven to the primary rest position, the grip member 2 returns to the flush position thanks to its grip member return means 26.

Because the secondary actuation mechanism 5 is configured to bring the primary actuation mechanism 4 to the primary rest position after a predetermined time period after reaching a predetermined activating position in the primary activation position range thanks to the damper or the damping element 530, the grip member 2 is displaced from the active position to the flush position after a predetermined time period.

Thanks to the damper or the damping element 530 of the secondary actuation mechanism 5, the grip member 2 can return to the flush position with a damping effect.

According to the first variation, the primary activating position range of the primary actuation mechanism 4 includes a set of positions included between 12° and 15° relative to the primary rest position. This configuration permits to drive the grip member 2 toward an active position range comprising a set of positions included between 12° and 15° relative to the flush position which permits to the user to grasp the gripping part 22 of the handle.

According to a second variation of the present disclosure, the secondary actuation lever 52 is configured to return toward the secondary rest position after a predetermined time period and not directly after reaching the secondary activating position.

This configuration permits the secondary actuation lever 52 to urge the primary actuation lever 44 after a predetermined time period and thus, the grip member 2 after a predetermined time period. For example, the secondary actuation lever 52 can start returning to the secondary rest position after a predetermined time period included between 5 and 10 seconds.

This configuration corresponds for example to a stronger damping effect of damper and/or to a free range of movement of the secondary actuation lever 52 between an extreme position where the gripping part 22 has pushed the secondary actuation lever 52 and a position where the secondary actuation lever second end 52*b* comes into contact with the primary actuation lever 44.

According to the second variation, the grip member 2 is displaced from the active position range to the flush position after a predetermined time period, for example 5 or 10 seconds after reaching the active position range.

According to the second variation, the primary activating position range of the primary actuation mechanism 4 includes a single position included between 12° and 15° relative to the primary rest position. This configuration allows to drive the grip member 2 toward an active position range comprising a single position between 12° and 15° relative to the flush position which permits to the user to grasp the gripping part 22 of the handle 1.

Thanks to the damper or the damping element 530 of the secondary actuation mechanism, the grip member 2 can also return to the flush position with a damping effect.

Figure 6:
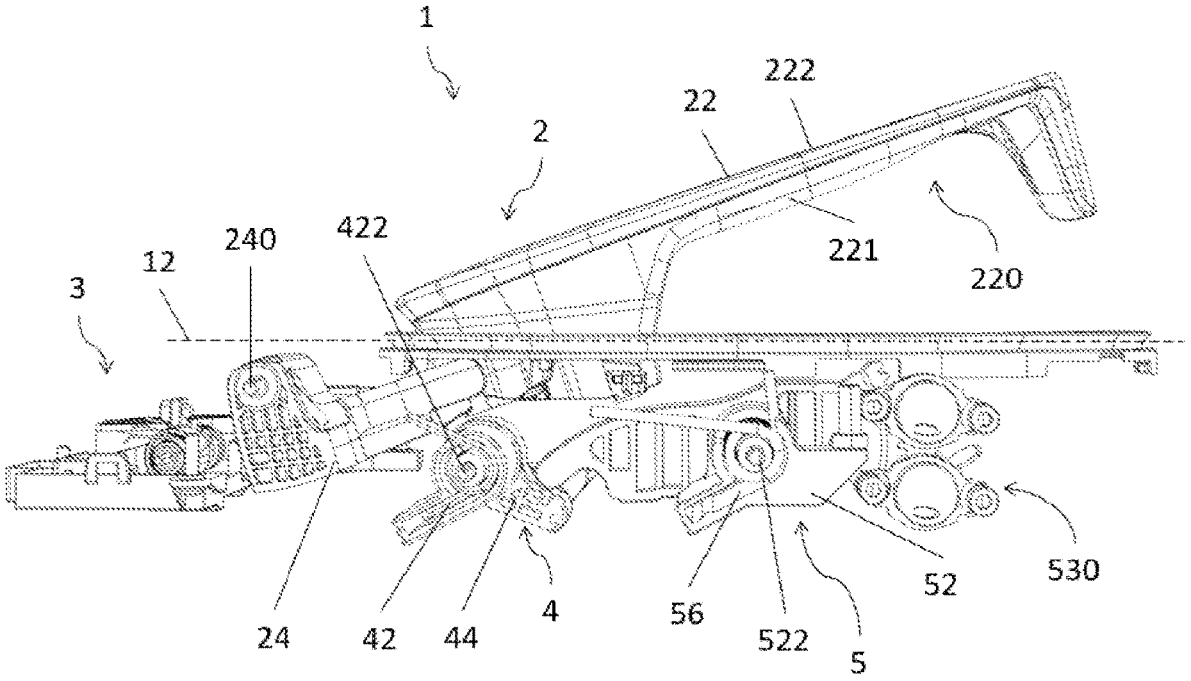
FIG. 6 is a top view of the handle of FIG. 1 in the open position.

FIG. 6 is a top view of the handle 1. FIG. 6 shows the primary actuation rotation axis 422 and the secondary actuation rotation axis 522, whereby the primary actuation rotation axis 422 and the secondary actuation rotation axis 522 may in particular be substantially parallel, i.e., may form a relative angle of less than 30°. Also the axis may be parallel with an external panel general plane, i.e., may form a relative angle of less than 30° with said plane. In this figure, the primary actuation return means 42 and the secondary actuation return means 56 are apparent. The grip member 2 includes the gripping part 22 and the grip lever 24. The grip member 2 has an outer cover 222 and an inner cover 221. In the FIGS. 1 to 4, the inner cover 221 is hidden.

The present disclosure has been described above with the aid of forms without limitation of the general inventive concept as defined in the claims.

Many modifications and variations will suggest themselves to those skilled in the art upon making reference to the foregoing illustrative forms, which are given by way of example only and which are not intended to limit the scope of the present disclosure, that being determined solely by the appended claims.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A handle for a vehicle door, comprising:

a grip member configured to cooperate with a latch of the vehicle door to unlatch the vehicle door, the grip member comprises a gripping part, the grip member being movable between:

a flush position in which the gripping part extends flush to an external panel of the vehicle door;

an active position range in which the gripping part projects with respect to the external panel and becomes graspable; and an opening position in which the grip member is configured to cooperate with the latch to unlatch the vehicle door, and wherein the grip member comprises a grip return device configured to drive the grip member toward the flush position;

a primary actuation mechanism moveable between:

a primary activating position range in which the primary actuation mechanism is configured to cooperate with the grip member and to urge said grip member towards the active position range; and a primary rest position in which the primary actuation mechanism is configured to release the grip member; and a secondary actuation mechanism moveable between:

a secondary activating position range in which the secondary actuation mechanism is configured to cooperate with the primary actuation mechanism and to urge the primary actuation mechanism toward the primary rest position; and a secondary rest position in which the secondary actuation mechanism is configured to retain the primary actuation mechanism in the primary rest position, wherein the secondary actuation mechanism is configured to bring the primary actuation mechanism to the primary rest position after a predetermined time period after reaching a predetermined activating position in the primary activation position range, wherein the primary actuation mechanism comprises a first return device configured to drive the primary actuation mechanism toward the activating position range, wherein the secondary actuation mechanism comprises a second return device configured to drive the primary actuation mechanism toward the primary rest position, and wherein a force of the second return device is greater than a force of the first return device and the force of the first return device is greater than a force of the grip return device, the force of the second return device being generated by the second return device itself.

2. The handle according to claim 1, wherein the grip member is configured to be moveable to a pushed position wherein the grip member is configured to push the secondary actuation mechanism towards the secondary activating position range.

3. The handle according to claim 1, wherein the grip member is displaced from the active position range to the flush position with a damping effect.

4. The handle according to claim 1, wherein the second return device comprises a damper or a damping element.

5. The handle according to claim 1, wherein the grip member is displaced from the active position range to the flush position after the predetermined time period.

6. The handle according to claim 5, wherein the predetermined time period is between 5 and 10 seconds.

7. The handle according to claim 1, wherein the grip member is configured to be moveable to a pushed position wherein the grip member is configured to push the secondary actuation mechanism towards the secondary activating position range, and wherein the grip member is displaced from the active position range to the flush position after the predetermined time period.

8. The handle according to claim 7, wherein the predetermined time period is between 5 and 10 seconds.

9. The handle according to claim 1, wherein the grip member is displaced from the active position range to the flush position with a damping effect, and wherein the grip member is displaced from the active position range to the flush position after the predetermined time period.

10. The handle according to claim 9, wherein the predetermined time period is between 5 and 10 seconds.

11. The handle according to claim 1, wherein the second return device comprises a damper or a damping element, and wherein the grip member is displaced from the active position range to the flush position after the predetermined time period.

12. The handle according to claim 11, wherein the predetermined time period is between 5 and 10 seconds.

13. The handle according to claim 1, wherein the predetermined time period is between 5 and 10 seconds.

* * * * *